US011468756B2

(12) United States Patent
Morita et al.

(10) Patent No.: US 11,468,756 B2
(45) Date of Patent: Oct. 11, 2022

(54) INTEGRATED CIRCUIT FOR SMOKE DETECTOR HAVING COMPATIBILITY WITH MULTIPLE POWER SUPPLIES

(71) Applicant: Texas Instruments Incorporated, Dallas, TX (US)

(72) Inventors: Shinya Morita, Plano, TX (US); Grant Evan Falkenburg, Dallas, TX (US); Mehedi Hassan, Plano, TX (US); Lundy Findlay Taylor, Plano, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 232 days.

(21) Appl. No.: 16/838,995

(22) Filed: Apr. 2, 2020

(65) Prior Publication Data

US 2021/0312780 A1 Oct. 7, 2021

(51) Int. Cl.

| | |
|---|---|
| ***G08B 17/10*** | (2006.01) |
| ***G08B 17/113*** | (2006.01) |
| ***G08B 17/06*** | (2006.01) |
| ***G08B 17/103*** | (2006.01) |

(52) U.S. Cl.

CPC ..... *G08B 17/113* (2013.01); *G08B 17/06* (2013.01); *G08B 17/103* (2013.01)

(58) Field of Classification Search

CPC .... G08B 17/113; G08B 17/06; G08B 17/103; G08B 17/10

See application file for complete search history.

(56) References Cited

U.S. PATENT DOCUMENTS

| | | | |
|---|---|---|---|
| 4,445,031 | A | 4/1984 | Kamoshida |
| 5,912,626 | A | 6/1999 | Soderland |
| 5,982,158 | A | 11/1999 | Schnars |
| 8,362,842 | B1 | 1/2013 | Xu |
| 8,510,068 | B2 | 8/2013 | Kawashima |
| 9,148,094 | B1 | 9/2015 | Swoboda |
| 9,438,353 | B2 | 9/2016 | Yun |

(Continued)

FOREIGN PATENT DOCUMENTS

| | | | |
|---|---|---|---|
| CN | 105045185 | A | 11/2015 |
| CN | 204991123 | U | 1/2016 |

(Continued)

OTHER PUBLICATIONS

PCT Search Report & written Opinion dated Aug. 5, 2021.

*Primary Examiner* — Toan N Pham

(74) *Attorney, Agent, or Firm* — John R. Pessetto; Charles A. Brill; Frank D. Cimino

(57) ABSTRACT

An AFE chip for a smoke detector includes a DC/DC boost converter having a boost input, a boost output, and a boost upper power supply input. The boost input is coupled to a first pin that is adapted for coupling to a battery through an inductor and the boost output is coupled to a second pin. The DC/DC boost converter is configured to not switch when a voltage on the second pin is greater than a programmed boost voltage. A set of power regulator circuits have a power input, which is coupled to a third pin, and a power output. The third pin is adapted for receiving an input voltage, the power output is coupled to provide an internal voltage, and the set of power regulator circuits are further coupled to the boost upper power supply input.

20 Claims, 7 Drawing Sheets

(56) References Cited

U.S. PATENT DOCUMENTS

| | | | | |
|---|---|---|---|---|
| 9,710,001 | B2 | 7/2017 | Smith et al. | |
| 9,946,279 | B1 * | 4/2018 | Dinh | H03K 5/08 |
| 9,958,885 | B2 | 5/2018 | Smith et al. | |
| 2005/0276080 | A1 | 12/2005 | Okada | |
| 2006/0184847 | A1 | 8/2006 | Song | |
| 2008/0007344 | A1 | 1/2008 | Natzke | |
| 2011/0031419 | A1 | 2/2011 | Fukui | |
| 2011/0283141 | A1 | 11/2011 | Lee | |
| 2012/0161733 | A1 | 6/2012 | Hua | |
| 2013/0076324 | A1 | 3/2013 | Fujii | |
| 2016/0232781 | A1 | 8/2016 | Sangha | |
| 2016/0299518 | A1 | 10/2016 | Iwata | |
| 2017/0287309 | A1 | 10/2017 | Gerbus | |
| 2017/0351285 | A1 | 12/2017 | Iwata | |
| 2021/0312780 | A1 * | 10/2021 | Morita | G08B 17/10 |
| 2021/0327239 | A1 * | 10/2021 | Falkenburg | G08B 17/10 |

FOREIGN PATENT DOCUMENTS

| | | | | |
|---|---|---|---|---|
| CN | 205787995 | U | 12/2016 | |
| EP | 3812205 | A1 * | 4/2021 | H02J 7/0013 |
| GB | 2558877 | A | 7/2018 | |
| JP | 01248197 | A | 10/1989 | |
| JP | 03100814 | A | 4/1991 | |
| JP | 2010160750 | | 7/2010 | |
| RU | 537 | | 6/1995 | |
| RU | 54450 | U1 | 1/2006 | |
| RU | 2611021 | C2 | 12/2016 | |
| RU | 2638824 | | 11/2017 | |
| WO | 2018222905 | A | 6/2018 | |
| WO | 2019051815 | A1 | 3/2019 | |

* cited by examiner

INTEGRATED CIRCUIT FOR SMOKE DETECTOR HAVING COMPATIBILITY WITH MULTIPLE POWER SUPPLIES

BACKGROUND

The smoke alarm market requires a variety of power supply platforms to fit the needs of a variety of applications, so that that smoke alarm suppliers often develop and sell different power supply versions of their products. Each platform uses a different hardware configuration by changing either discrete components or integrated circuit (IC) chips. Having multiple power supply options with the same components is desirable.

SUMMARY

Disclosed embodiments provide an analog front end (AFE) chip for a smoke detector. The AFE chip can accept a wide range of power supply inputs while also supporting the 2020 UL requirements for smoke detectors. A pre-regulator on the AFE chip can accept a power supply input that has a voltage between about two (2) volts and about fifteen (15) volts and provide a safe voltage to other circuits on the AFE chip. This capability provides for the output of a DC/DC boost converter on the AFE chip to be coupled to the AFE power supply input. The DC/DC boost converter is default enabled, but can sense when a higher input voltage is provided and will turn off the DC/DC boost converter when not needed. These two capabilities provide for the AFE chip to be utilized with a variety of smoke detector power configurations.

In one aspect, an embodiment of an AFE chip for a smoke detector is disclosed. The AFE chip includes a DC/DC boost converter having a boost input, a boost output, and a boost upper power supply input, the boost input being coupled to a first pin, the boost output being coupled to a second pin, the first pin being adapted for coupling to a battery through an inductor, and the DC/DC boost converter being configured to not switch when a voltage on the second pin is greater than a programmed boost voltage; and a set of power regulator circuits having a power input and a power output, the power input being coupled to a third pin, the third pin being adapted for receiving an input voltage, the power output being coupled to provide an internal voltage to the digital upper supply input, the set of power regulator circuits being further coupled to the boost upper power supply input.

In another aspect, an embodiment of a smoke detection device is disclosed. The smoke detection device includes an AFE chip including a DC/DC boost converter having a boost input, a boost output, and a boost upper power supply input, the boost input being coupled to a first pin and the boost output being coupled to a second pin, and a set of power regulator circuits having a power input and a power output, the power input being coupled to a third pin, the third pin being adapted for receiving an input voltage, the power output being coupled to provide an internal voltage; and a trace that couples the second pin to the third pin.

In yet another aspect, an embodiment of a process of operating a smoke detector is disclosed. The process coupling an output pin for a DC/DC boost converter on an analog front end (AFE) chip to an input pin for a set of power regulator circuits on the AFE chip through a trace; and coupling a power supply to the AFE chip.

BRIEF DESCRIPTION OF THE DRAWINGS

Embodiments of the present disclosure are illustrated by way of example, and not by way of limitation, in the figures of the accompanying drawings in which like references indicate similar elements. It should be noted that different references to "an" or "one" embodiment in this disclosure are not necessarily to the same embodiment, and such references may mean at least one. Further, when a particular feature, structure, or characteristic is described in connection with an embodiment, it is submitted that it is within the knowledge of one skilled in the art to effect such feature, structure, or characteristic in connection with other embodiments whether or not explicitly described. As used herein, the term "couple" or "couples" is intended to mean either an indirect or direct electrical connection unless qualified as in "communicably coupled" which may include wireless connections. Thus, if a first device couples to a second device, that connection may be through a direct electrical connection, or through an indirect electrical connection via other devices and connections.

The accompanying drawings are incorporated into and form a part of the specification to illustrate one or more exemplary embodiments of the present disclosure. Various advantages and features of the disclosure will be understood from the following Detailed Description taken in connection with the appended claims and with reference to the attached drawing figures in which:

DETAILED DESCRIPTION OF THE DRAWINGS

Figure 1A:
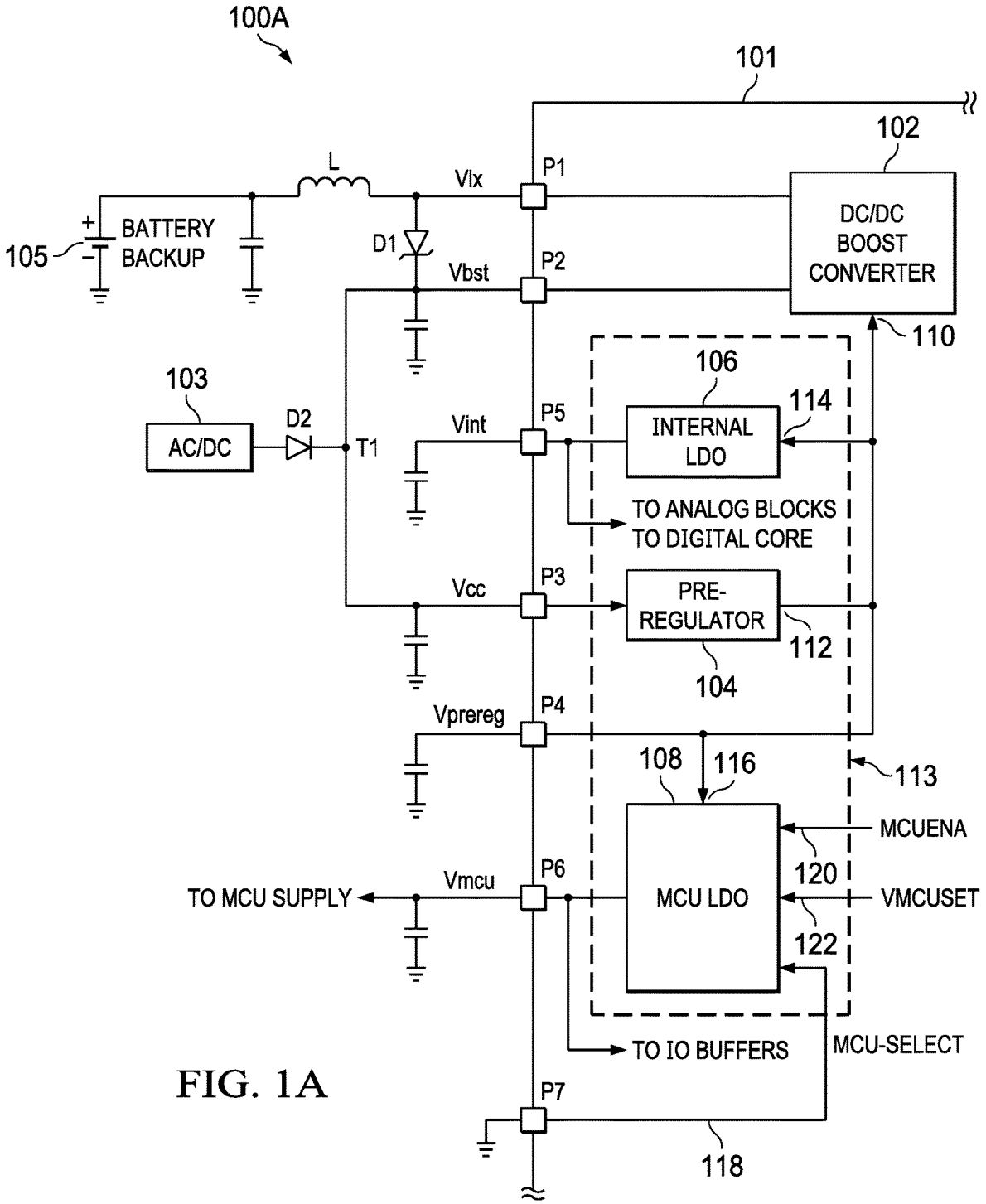
FIG. 1A depicts a power configuration in which the IC chip is coupled to an AC/DC converter with battery backup according to an embodiment of the disclosure.

Specific embodiments of the invention will now be described in detail with reference to the accompanying figures. In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The smoke alarm market requires a variety of power supply platforms. Commercial smoke alarms and many residential smoke alarms utilize DC power derived from a mains power supply with battery power as a backup when the power supply is lost. For example, one power supply platform uses the combination of 12 V DC input and a 3 V backup battery. Other power supply platforms rely solely on battery power and can utilize a low voltage input, typically a 3 V battery, or a high voltage input, e.g., a 9-12 V battery. These three platforms require different power management configurations because smoke alarm functions require different voltages that can be both lower and higher than these input voltages. For example, a horn driver function requires 10-12 V, while the smoke chamber AFE requires 2-3 V.

Depending on the power supply for a specific platform, the smoke alarm typically has either a DC/DC boost converter to provide higher voltage from low input voltage or a buck converter to provide lower voltages from a high input voltage; some configurations use both. A DC/DC boost converter typically generates 10-12 V from a lower voltage input, e.g., 3 V, while a buck converter typically generates 2-3 V from a higher voltage input like 9 V or 12 V. Smoke alarm suppliers historically develop and sell different power supply versions of their products. Each platform uses a different hardware configuration, varying either discrete components or IC chips. This situation is not ideal, both because of the costs of development for multiple platforms and the need to stock each of the multiple platforms' components. Within these platforms, the AFE ICs for a smoke detector generally accept only a lower voltage input, e.g., up to 5 V, because the AFE typically works with 2-3 V.

Applicants have designed a single IC chip that integrates an AFE with the power management to support multiple power supply combinations; this IC chip may be referred to herein as an AFE chip. The power input for the AFE chip is designed to have a wide input range, e.g., between 2-15 V. At the same time, a DC/DC boost converter on the AFE chip is enabled by default and is designed to be coupled to the power input for the AFE. The power supply input for the AFE is received at a pre-regulator, which is designed to receive the high voltage and to provide a power output that is in the range of 4-5 V. The output of the pre-regulator provides power to the DC/DC boost converter and to additional voltage regulators that provide power to other elements of the smoke detector.

The combination of a pre-regulator able to receive high voltages and a default-enabled DC/DC boost converter whose output is coupled to the input of the pre-regulator provides for the AFE chip to function with multiple power configurations. Using this combination, the disclosed AFE chip is able to support power configurations that can include a low voltage (3 V) battery only platform, a high voltage (9 V) battery only platform and a platform that combines 12 V DC power with a 3 V battery backup.

Not only does the disclosed IC chip provide versatility for use with different power platforms, but the overall power requirements are low. Underwriters Laboratories (UL) provided new requirements for certification of smoke alarms in 2018, with implementation of the requirements to be completed by early 2020. These requirements include the ability for the smoke alarm to be powered from a 3-volt lithium battery for a ten-year life span of the smoke alarm, which imposes very strict limitations on power usage. The disclosed AFE chip supports this requirement.

Figure 1B:
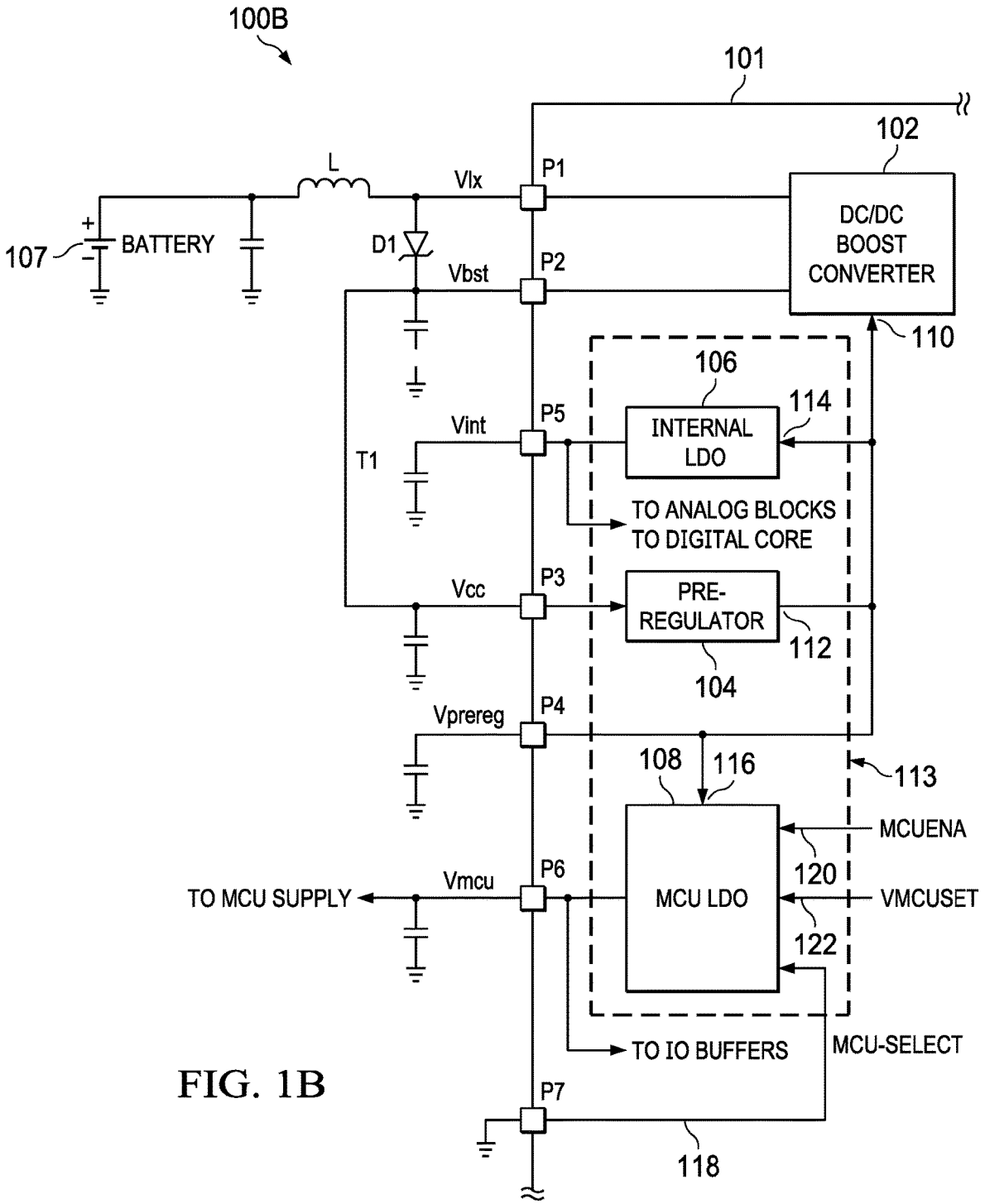
FIG. 1B depicts a power configuration in which the IC chip is coupled only to a low-voltage battery according to an embodiment of the disclosure.
Figure 1C:
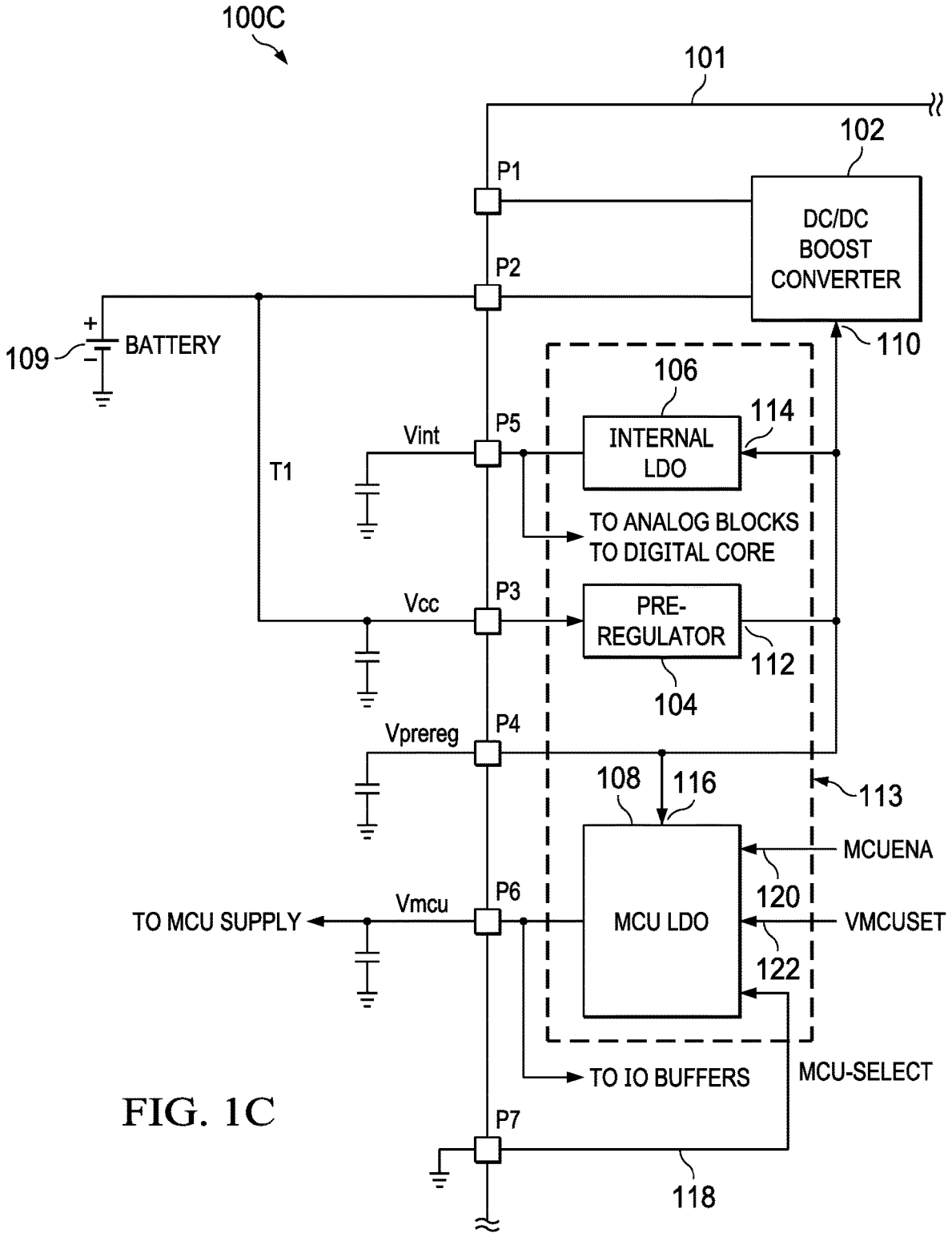
FIG. 1C depicts a power configuration in which the IC chip is coupled to a battery having a higher voltage, e.g., 9-12 V, according to an embodiment of the disclosure.

FIGS. 1A-1C each depicts a portion of a smoke detection device 100 that includes an AFE chip 101 according to an embodiment of the disclosure. AFE chip 101 can contain a number of circuits used in the detection of smoke and/or carbon monoxide (CO) that are not specifically shown in these figures in order to emphasize the distinctions of the disclosed embodiments. AFE chip 101 includes a DC/DC boost converter 102 and a set of power regulator circuits 113 that provide the desired levels of power. In one disclosed embodiment the set of power regulator circuits 113 includes a pre-regulator circuit 104, an internal LDO regulator 106, and a microcontroller unit (MCU) LDO regulator 108. It can be noted that the set of power regulator circuits 113 can be larger or smaller than the set specifically shown in these figures. For example, if an AFE chip is not powering an MCU, an MCU LDO can be omitted. Similarly, if the internal LDO regulator 106 and the MCU LDO regulator 108 (if present) are adapted to work with the voltage on the third pin, then the pre-regulator circuit 104 is not necessary.

DC/DC boost converter 102 has a boost input that is coupled to a first pin P1, a boost output that is coupled to a second pin P2 and a boost upper power supply input 110. First pin P1 can be coupled to a low-voltage battery, e.g., a battery that provides 3.0-3.6 V, although over time, the battery power can diminish to about 2 V and still provide power to AFE chip 101, attached sensors, and an attached MCU (not specifically shown in these figures). DC/DC boost converter 102 operates with a wide range of input and output voltages and can support multiple battery configurations and driver voltages. A programmed boost voltage VPGM can be set to indicate a desired boosted output voltage Vbst. DC/DC boost converter 102 provides a power-good signal BST_PG that can be sent to a register in the digital core (not specifically shown in this figure) to notify the MCU when the boost converter is above 95% of the programmed boost voltage VPGM. The power-good signal BST_PG is set low when the DC/DC boost converter 102 is disabled.

Several register bits can be used to control the activity of the DC/DC boost converter 102. A boost enable register bit BST_EN is set to "1" if DC/DC boost converter 102 is to be enabled and is set to "0" if DC/DC boost converter 102 is to be disabled. A boost sleep register bit SLP_BST can be set to "1" if the DC/DC boost converter 102 is to be disabled during a sleep mode, e.g., for low-voltage battery operation, and can be set to "0" if the DC/DC boost converter 102 is to remain unchanged during a sleep mode, e.g., when operating from an AC/DC converter. When the smoke detection device 100 is in a sleep mode, which will be explained in greater detail below, boost sleep register bit SLP_BST disables DC/DC boost converter 102 if the DC/DC boost converter 102 is enabled with boost enable register bit BST_EN. The boost charge register bit BST_CHARGE can enable the boost converter until the power-good signal BST_PG is high, at which point boost charge register bit BST_CHARGE resets to "0" and the DC/DC boost converter 102 is disabled. Other register bits can be used to enable the DC/DC boost converter 102 in cases where certain errors occur in pre-regulator circuit 104 or MCU LDO regulator 108.

The default enabled DC/DC boost converter 102 can support powering up from an AC/DC power supply that provides about 12 V and a backup battery that provides about 3 V. When the AC/DC power supply is connected and the power supply at second pin P2 is greater than the boosted output voltage Vbst, the DC/DC boost converter 102 does not switch and no power is drawn from the battery. When the AC/DC power supply is lost, the DC/DC boost converter 102 is automatically enabled and generates boosted output voltage Vbst from the battery voltage Vbat. If only a 3 V battery is connected, the default enabled DC/DC boost converter can provide the higher voltage. This guarantees that the power supply input for AFE chip 101 can be powered with high voltage when any of a battery, a 12 V DC power supply, or both are connected.

Pre-regulator circuit 104 has a pre-regulator input that is coupled to a third pin P3 and a pre-regulator output 112 that is coupled to the boost upper power supply input 110 and is also coupled to a fourth pin P4. As noted previously, pre-regulator circuit 104 can receive an input voltage Vcc that can range between about 2 V, e.g., during startup, and about 15 V. When the power supply input is less than about 4 V, pre-regulator circuit 104 will simply pass the input voltage Vcc on to the other circuits that use the power. Once the power supply input rises above about 4 V, the output of pre-regulator circuit 104 is regulated, with an output in the range of about 4 V to about 5.5 V.

Internal LDO regulator 106 has an internal-LDO upper power supply input 114 that is coupled to the pre-regulator output 112 and an internal-LDO output that is coupled to a fifth pin P5. During operation of internal LDO regulator 106, internal LDO regulator 106 receives the voltage provided by pre-regulator circuit 104, which is not as tightly regulated as needed by some of the internal circuits, and provides a well-regulated internal voltage Vint to analog blocks and to a digital core, which are not specifically shown in these figures. In one embodiment, the voltage provided by internal LDO regulator 106 is about 2.3 V.

MCU LDO regulator 108 has an MCU-LDO upper power supply input 116, an MCU-LDO output, and an MCU-select input 118. The MCU-LDO upper power supply input 116 is coupled to the pre-regulator output 112, the MCU-LDO output is coupled to a sixth pin P6, and the MCU-select input 118 is coupled to a seventh pin P7. In one embodiment, MCU LDO regulator 108 is also coupled to receive an MCU-voltage-setting signal VMCUSET 122 and an MCU-enable signal MCUENA 120. In one embodiment, MCU LCO regulator 108 can provide an MCU voltage Vmcu that can be set between about 1.5 V to about 3.3 V. The MCU-select input 118 and the seventh pin P7 are used to set an initial value of the MCU voltage Vmcu from a selection of possible settings, while MCU-voltage-setting signal VMCUSET 122 is stored in an internal register on AFE chip 101 (not specifically shown in this figure) that can be programmed by the MCU to a final voltage setting once the MCU is operating. MCU-enable-signal MCUENA 120 is an internal signal that can be used to signal when the MCU should be woken up after entering a sleep period. Similar to DC/DC boost converter 102, MCU LDO regulator 108 can be disabled during a sleep mode if an MCU sleep register bit SLP_MCU is set to "1" and can be left unchanged during the sleep mode if MCU sleep register bit SLP_MCU is set to "0". If the MCU LDO 108 was enabled prior to sleep mode, the MCU LCO 108 is re-enabled when sleep mode is exited.

Taken as a whole, the set of power regulator circuits 113 has a power input and a power output. In the present embodiment, the power input is coupled to the third pin to receive input voltage Vcc and the power output is coupled within the AFE 100 to a number of analog blocks and to the digital core (neither specifically shown in this figure) to provide internal voltage Vint. The set of power regulator circuits 113 is also coupled to the boost upper power supply input 110. While FIGS. 1A-1C each depict the same AFE chip 101, they do so with three different power configurations in order to describe the flexibility of the power regulating circuits of AFE chip 101. In FIG. 1A, smoke detection device 100A includes an AC/DC converter 103 and a battery backup 105, which are coupled to AFE chip 101. In one embodiment, AC/DC converter 103 provides a power supply of 11.5 V and battery backup 105 is designed to deliver 3-3.6 V of power, although near the end of the ten-year lifetime of the smoke alarm, the battery may provide only about 2 V. The battery backup 105 is coupled to the first pin P1 through an inductor L. Second pin P2 is coupled to the third pin P3 through a trace T1 on a circuit board (not specifically shown). A first diode D1, e.g., a Schottky diode, is coupled between the first pin P1 and the second pin P2.

AC/DC converter 103 is coupled to the trace T1 through a second diode D2. It can be noted here that the voltage on second pin P2 is referred to as boosted output voltage Vbst herein, even when the DC/DC boost converter 102 is not supplying the power. This convention is used because the boosted output voltage Vbst on second pin P2 is provided through internal metallization layers to other circuits on AFE chip 101, e.g., a horn driver circuit and an interconnect I/O buffer (neither of which are specifically shown in this figure). When mains power is available, AC/DC converter 103 supplies a boosted output voltage Vbst that can be equal to or greater than the programmed boost voltage VPGM, e.g., about 11.5-15 V. The DC/DC boost converter 102 senses the voltage on second pin P2 and does not switch when the boosted output voltage Vbst is equal to or greater than the programmed boost voltage VPGM, so that no power is drawn from the battery. When mains power fails, the current provided by AC/DC converter 103 disappears. When the voltage drop is sensed, the DC/DC boost converter is automatically enabled and generates the boosted output voltage Vbst at the programmed boost voltage VPGM from the 3 V battery backup 105.

When the boosted output voltage Vbst is below the programmed boost voltage VPGM, a charging cycle is initiated. When the boosted output voltage Vbst is above the programmed boost voltage VPGM, the DC/DC boost converter does not switch. In a battery backup system, no power is drawn from the battery while the AC/DC converter is providing a boosted output voltage Vbst above the boost regulation voltage. The boost starts switching if the AC/DC supply drops, drawing power from the battery to regulate boosted output voltage Vbst. In one embodiment a boost timer BST_nACT monitors the time that the boost is not switching and notifies the MCU if the boost is inactive. Boost timer BST_nACT can be programmable, e.g., from 100 μs to 100 ms and can be used to determine if the power is being received from a battery having a voltage higher than the programmed boost voltage VPGM or from an AC/DC converter.

Several power-saving options have been incorporated into AFE chip 101. The pre-regulator circuit 104 is able to operate with only 2-3 V as a power supply, as are other circuits powered by the pre-regulator circuit 104. However, an attached horn and other circuits that will be explained below require the higher voltage provided by DC/DC boost converter 102. When AFE chip 101 is operating on 3-V battery power and the programmed boost voltage VPGM is not currently needed, e.g., when none of the circuits that require the programmed boost voltage VPGM are active, DC/DC boost converter 102 can be disabled while first diode D1 provides for a current to flow directly from the battery to the pre-regulator circuit 104, bypassing DC/DC converter 102. However, when powering-up with a low-voltage battery, an attached MCU may require an MCU voltage Vmcu that is greater than the battery voltage but less than the voltage required by the horn driver. In this situation, DC/DC boost converter 102 is changed to provide an intermediate voltage to provide the necessary MCU voltage Vmcu.

FIG. 1B depicts AFE chip 101 having a battery 107 that is coupled to first pin P1 through an inductor L. As in FIG. 1A, trace T1 is coupled between the second pin P2 and third pin P3 and first diode D1 is coupled between the first pin P1 and the second pin P2. The main difference between battery 107 of FIG. 1B and the battery backup 105 of FIG. 1A is that battery 107 operates as the sole source of power for AFE chip 101, while battery backup 105 serves as a backup to the primary power supply. Battery 107 again has an initial voltage in the range of about 3.0-3.6 V, but over the lifetime of smoke alarm 100B, the voltage on battery 107 may drop as low as about 2 V without affecting operation of the smoke alarm 100B.

During operation of smoke alarm 100B, DC/DC boost converter 102 will be turned on during periods when the higher voltage is necessary, e.g., during operation of the horn (not specifically shown in this figure) or during operation of other circuits that need a higher voltage. These additional circuits will be explained below. When the higher voltage is not necessary, power is received at pre-regulator circuit 104 directly from battery 107 through first diode D1 and is provided by pre-regulator circuit 104 directly to internal LDO regulator 106 and MCU LDO regulator 108. The DC/DC boost converter 102 generates 10-12 V for horn driver supply from battery 107 when needed. This DC/DC boost converter 102 is automatically enabled on power-up to support power-up from a battery as low as 2 V. Once the device is powered up, the battery voltage can drop further and keep the device powered through the DC/DC boost converter.

Of particular interest is a situation in which battery 107 or backup battery 105 is coupled to AFE chip 101, but the battery has been depleted to 2 V and no other supply is coupled beforehand. In this setting, if an MCU coupled to AFE chip 101 requires 3.3 V, there is no means to provide power to the MCU except by turning on DC/DC boost converter 102 on. DC/DC boost converter 102 is automatically turned on and determines a voltage required for an MCU, e.g., based on the how the seventh pin P7 is coupled. DC/DC boost converter 102 then provides a voltage appropriate to turn on the MCU without any external programming.

FIG. 1C depicts a third configuration for a smoke detector 100C in which a high voltage battery 109 is used, e.g., a 9 V or 12 V battery, so that the DC/DC boost converter 102 is not generally necessary. As seen in smoke detector 100C, trace T1 is coupled between second pin P2 and third pin P3 and battery 109 is coupled to the trace T1. First pin P1 receives no input and is left floating. When power is applied to smoke detection device 100C, DC/DC boost converter 102 is automatically enabled, senses the high voltage on second pin P2 to verify the device is ready to power-up, and can be disabled during operation. Pre-regulator circuit 104 provides a voltage in the range of 4-5 V to internal LDO regulator 106 and to MCU LDO regulator 108 and when higher voltages are needed, e.g., by a horn driver (not specifically shown), the higher voltages is obtained using an internal coupling to second pin P2 (not specifically shown).

Figure 2:
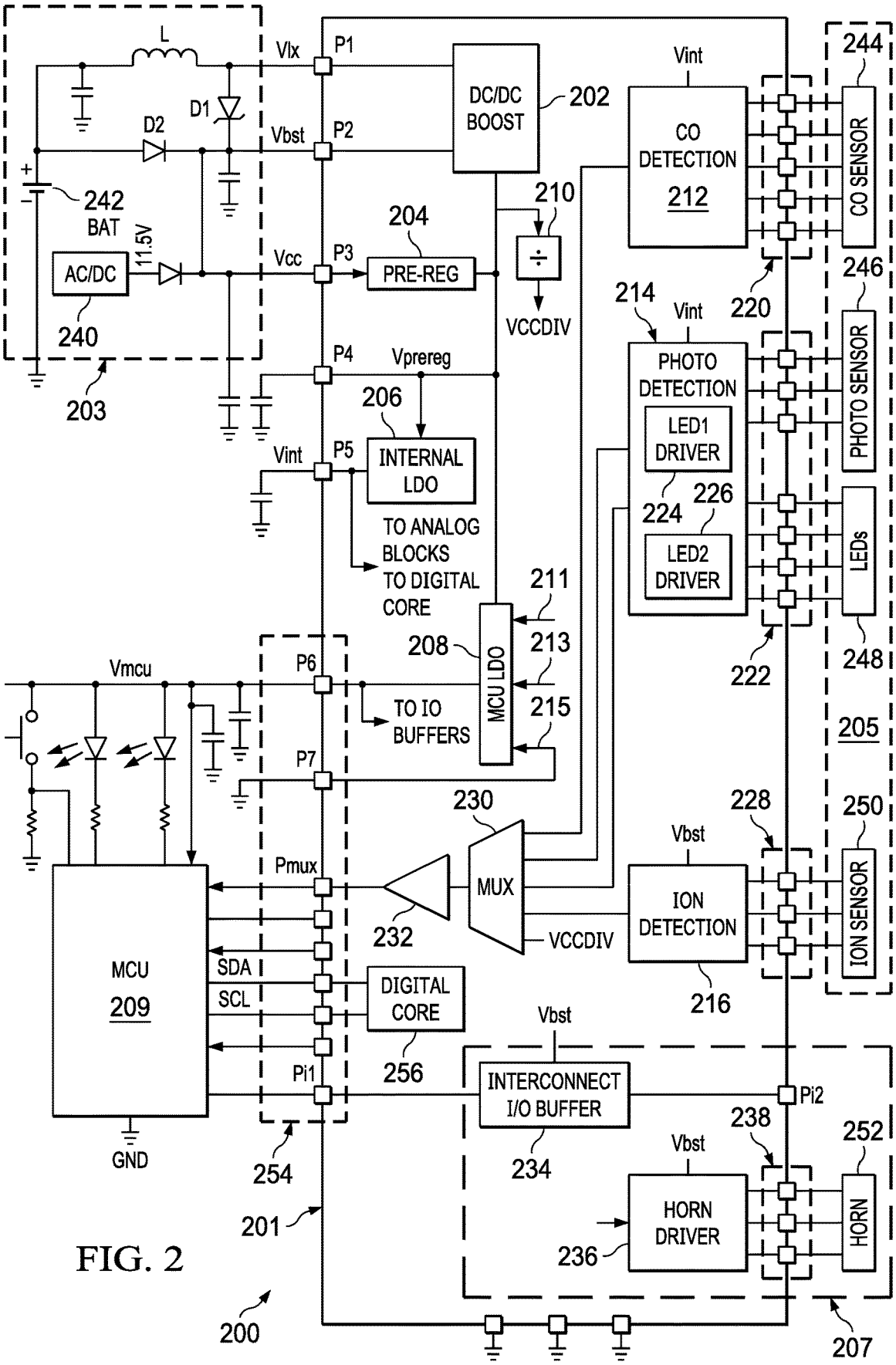
FIG. 2 depicts an example of a smoke detection device that includes an IC chip according to an embodiment of the disclosure.

FIG. 2 depicts a block diagram of a smoke detector, also known as a smoke detection device 200, which is adapted to utilize a range of input voltages between about 2 volts and about 15 volts according to an embodiment of the disclosure. Smoke detection device 200 includes five basic sections: an AFE chip 201, a power source 203, one or more sensors 205, a warning system 207, and an MCU chip 209.

The AFE chip 201 includes a DC/DC boost converter 202, a pre-regulator circuit 204, an internal LDO regulator 206, an MCU LDO regulator 208 and a voltage divider 210. As shown in smoke detection device 200, DC/DC boost converter 202, pre-regulator circuit 204, internal LDO regulator 206, and MCU LDO regulator 208 correspond to their respective counterparts in FIGS. 1A-1C and are coupled as previously discussed in those figures. In one embodiment, DC/DC boost converter 202 provides a boosted output voltage Vbst of about 11.5 V, pre-regulator circuit 204 provides a pre-regulator output voltage Vprereg that is between about 4 V and about 5.4 V, internal LDO regulator 106 provides an internal voltage Vint of about 2.3 V, and MCU LDO 108 is able to provide a selectable MCU voltage Vmcu that is between about 1.2 V and about 3.3 V. In one embodiment, MCU LDO regulator 208 is further coupled to receive an MCU-select input 215 from seventh pin P7 that can be used to set an initial value of the MCU voltage Vmcu and an MCU-voltage-setting signal VMCUSET 213 that can be provided by the MCU chip 209 once the MCU is operating. MCU LDO regulator 208 can also receive an MCU enable signal MCUENA 211 that signals when the MCU should be woken up after entering a sleep period. In one embodiment, seventh pin P7 can be coupled to a) ground, b) left floating, c) internal voltage Vint, and d) ground via a 620Ω resistor, where each possible connection correlates to an initial MCU voltage Vmcu.

AFE chip 201 also includes sensor drivers, e.g., a CO detection circuit 212, a photo-detection circuit 214, and an ion detection circuit 216. In one embodiment as shown, CO detection circuit 212 has a CO upper power supply input that is coupled to receive power from the internal LDO 206; CO detection circuit 212 is further coupled to a plurality of CO pins 220. Photo-detection circuit 214 has a photo upper power supply input that is coupled to receive power from the internal LDO 206; photo-detection circuit 212 is further coupled to a plurality of photo-detection pins 222. In one embodiment, photo-detection circuit 214 includes a first light-emitting diode (LED) driver 224 and a second LED driver 226. Ion detection circuit 216 has an ion upper power supply input that is coupled to receive power from DC/DC boost converter 202; ion detection circuit 216 is further coupled to a plurality of ion pins 228.

In order to supply the information collected by the sensors 205, multiplexor 230 is coupled to a CO output from the CO detection circuit 212, a first photo output and a second photo output from the photo-detection circuit 214, an ion output from the ion detection circuit 216, and VCC voltage divider 210, which provides divided voltage Vccdiv. By passing divided voltage Vccdiv to MCU chip 209, MCU chip 209 is able to monitor the voltage that pre-regulator circuit 204 is able to provide. This can be especially important when smoke detection device 200 is operating from a low-voltage battery, such as battery backup 105 or battery 107. Multiplexor 230 has a MUX upper power supply input that is coupled to receive power from the internal LDO 206. Multiplexor 230 is further coupled to selectively provide the data from the detection circuits through a buffer amplifier 232 to a MUX pin Pmux. The final elements of the AFE circuitry in AFE chip 201 as shown are an interconnect I/O buffer 234 and a horn driver 236. Interconnect I/O buffer 234 has an upper power supply input that is coupled to receive power from DC/DC boost converter 202 and interconnect I/O buffer 234 is further coupled to a first interconnect pin Pi1 and a second interconnect pin Pi2 and will be further explained below. Horn driver 236 is also coupled to receive power from boosted output voltage Vbst and is further coupled to a plurality of horn pins 238.

Power source 203 will generally include a battery, which may be used to as backup power in case of a power outage or as the primary power source for smoke detection device 200, and may also include a connection to mains power through an AC/DC converter. As seen in FIG. 2, power source 203 includes AC/DC converter 240 and a battery backup 242, but can include other power configurations, including any of the power configurations described herein.

Sensors 205 can include CO sensors 244, photo sensor(s) 246, LEDs 248, and ion sensor 250 or some combination of these sensors. For example, not every smoke detection device 200 will contain a CO sensor 244 and not every smoke detection device 200 will contain an ion sensor 250. When present, CO sensor 244 is coupled to CO detection circuit 212 through the plurality of CO pins 220 and ion sensor 250 is coupled to ion detection circuit 216 through the plurality of ion pins 228.

Current UL standards require the ability to distinguish between different types of fires, which have different particle sizes. To address this, many smoke detection devices 200 now include two different LEDs 248, e.g., a blue LED and an infrared LED. Each of the LEDs 248 is coupled to either the first LED driver 224 or to second LED driver 226 and each is used with a different photo sensor 246. Both photo sensor(s) 246 and LEDs 248 are coupled to photo-detection circuit 214 through the plurality of photo pins 246.

Warning system 207 is the means by which problems detected by smoke detection device 200 can be conveyed to people who are in the affected building and/or monitoring the building. As shown, warning system 207 can include an attached horn 252, horn driver 236, and interconnection capabilities for connecting to a centralized alarm system, e.g., interconnect I/O buffer 234. When a horn is used, horn 252 can be attached to horn pins 236. If it is desired to connect multiple residential smoke detection devices 200 together, interconnect I/O buffer 234 provides the means for the smoke detection devices to communicate with each other. Commercial smoke detection systems generally do not utilize either a horn within the individual smoke alarms or the interconnection capabilities, but use a signal line circuit (SLC) instead. Both interconnect I/O buffer 234 and horn driver 236 are also designed to be compatible with SLC and both the plurality of horn pins 238 and second interconnect pin Pi2 can be used for coupling to the centralized alarm system and for communicating therewith. As will be seen, first pin Pi1 is coupled to MCU chip 209, so that the MCU chip 209 can communicate with the centralized alarm system.

MCU chip 209 is coupled to AFE chip 201 through a plurality of MCU pins 254, which include sixth pin P6, MUX pin Pmux, first interconnect pin Pi1, and a number of additional pins that can be utilized for general purpose I/O, for programming registers (not specifically shown in this figure) in a digital core 256, and for controlling various functions through AFE chip 201.

In one embodiment, the AFE chip 201 integrates a sleep timer to help manage critical analog and regulator circuits independent of the MCU chip 209. When a sleep mode is enabled by MCU chip 209, the sleep timer starts. A number of circuits on AFE chip 201, e.g., MCU LDO regulator 208, DC/DC boost converter 202, multiplexor 230, portions of photo-detection circuit 214, and portions of ion detection circuit 216 may be disabled. In one embodiment, whether or not the DC/DC boost converter 202, the MCU LDO regulator 208, and the analog blocks are disabled depends on respective settings in the boost sleep register bit SLP_BST, the MCU sleep register bit SLP_MCU, and an analog sleep register bit SLP_ANALOG. After the sleep timer finishes, the AFE chip 201 notifies MCU chip 209 that the sleep mode can be exited. When AFE chip 201 exits the sleep mode, the circuits on AFE chip 201 are set to their pre-sleep state.

Sleep mode reduces power consumption in three ways:

- by quickly disabling analog blocks;
- by powering off the DC/DC boost converter 202 and the MCU LDO regulator 208 during sleep mode; and
- by providing for the MCU to enter its lowest power idle state.

During sleep mode operation, the MCU chip 209 can enter its lowest power idle state and monitor a general purpose I/O pin for the indication that the sleep period is exited. This monitoring provides for the clocks on MCU chip 209 to be disabled as AFE chip 201 signals the MCU to wake up after a precise programmed time, which in one embodiment is programmable.

Figure 2A:
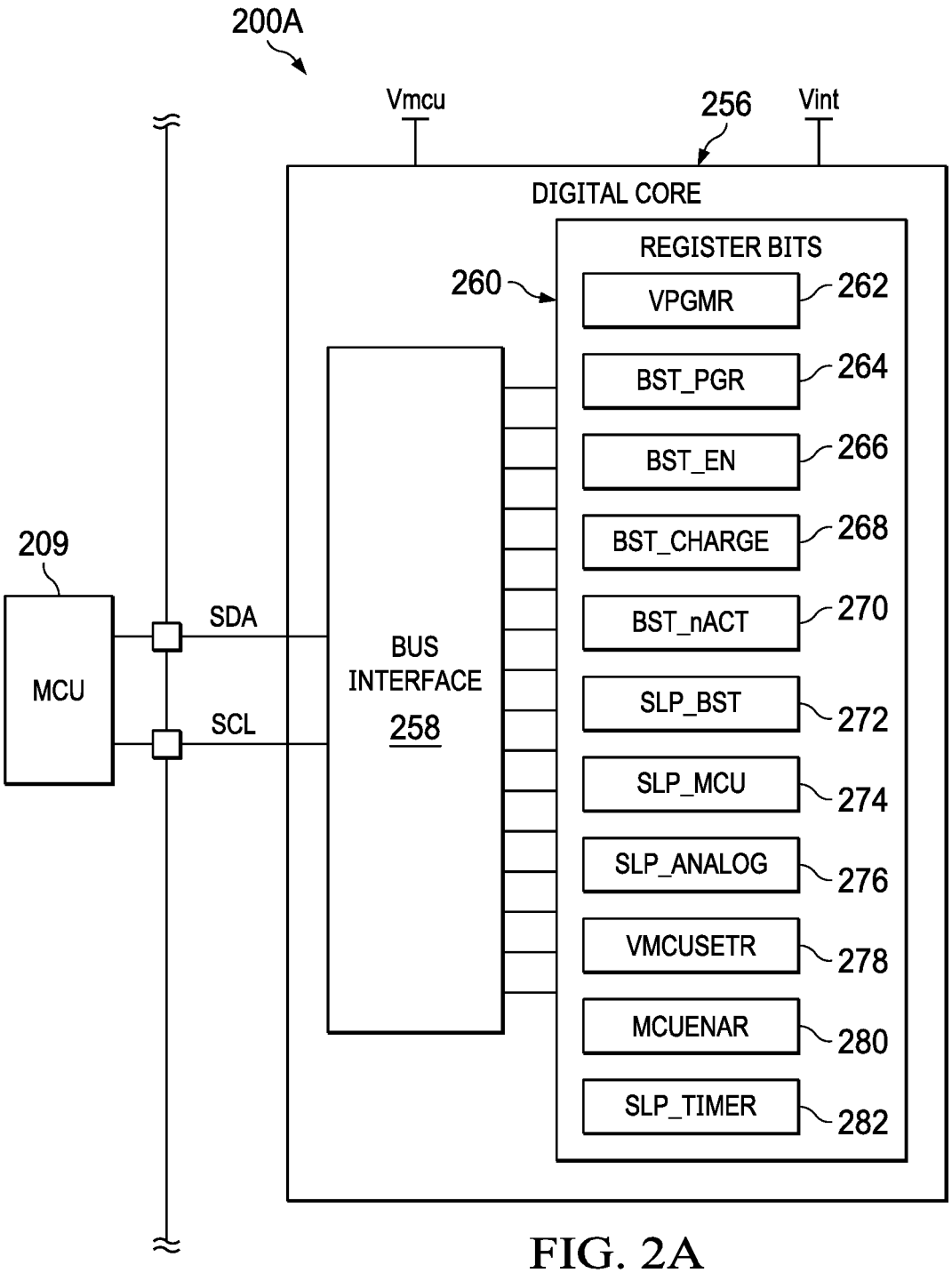
FIG. 2A depicts a more detailed version of the digital core according to an embodiment of the disclosure.

FIG. 2A a more detailed version of the digital core 256 and corresponding connections to the MCU chip 209. Shown as part of the digital core 256 in this embodiment are a bus interface 258 and storage that contains register bits 260, although these elements may also be implemented as separate circuits that are coupled the digital core. The bus interface 258 is coupled to a serial data pin SDA and to a serial clock pin SCL; in the smoke detection device 200, the serial data pin SDA and the serial clock pin SCL are coupled to a bus interface (not specifically shown) in the MCU chip 209. In one embodiment, the bus interface 258 is an Inter-Integrated Circuit (I2C) interface that utilizes the I2C communication protocol. Because the bus interface 258 needs to operate in two separate voltage domains in order to work with both the digital core 256 and the MCU 209, digital core 256 receives both the MCU voltage Vmcu at an MCU upper supply input 257 and the internal voltage Vint at a digital upper supply input 259.

The register bits 260 contain a large number of registers/register bits that can be utilized to provide parameters and control for smoke detection device 200. Only a few of the register bits 260 are shown in FIG. 2A. The programmed boost voltage VPGM is set through MCU chip 209 and is stored in a programmed boost voltage register bit VPGMR 262. The power-good signal BST_PG is set by DC/DC boost converter 202 and stored in a power-good register bit BST_PGR 264 to notify the MCU chip 209 when the DC/DC boost converter 202 is above 95% of the programmed boost voltage VPGM. Boost enable register bit BST_EN 266 can be used to enable or disable the DC/DC boost converter 202 and can be controlled by the MCU chip 209. Boost enable register bit BST_EN 266 can also be controlled by the sleep timer if the DC/DC boost converter 202 is turned off during sleep mode. The boost charge register bit BST_CHARGE 268 can be set to provide additional control of DC/DC boost converter 202, e.g., when turned on, DC/DC boost converter 202 is enabled until the programmed boost voltage register bit VPGMR 262 is turned on; when turned off, the boost enable register bit BST_EN 266 provides the control. A boost activity monitor register bit BST_nACTR 270 is turned on by the DC/DC boost converter 202 when the boost timer BST_nACT indicates that the DC/DC boost converter 202 has not switched for a pre-selected amount of time. The MCU chip 209 can use the boost activity monitor register bit BST_nACTR 270 to determine that the current power configuration is not utilizing the DC/DC boost converter 202, e.g., because a power supply that provides greater than the programmed boost voltage VPGM is coupled to provide the input voltage VCC.

The boost sleep register bit SLP_BST 272, the MCU sleep register bit SLP_MCU 274, and the analog sleep register bit SLP_ANALOG 276 are used to determine whether the respective circuits DC/DC boost converter 202, MCU LDO regulator 208, and the analog blocks are disabled during sleep mode. The analog blocks can include, e.g., the high-power amplifiers and drivers such as multiplexor 230, horn driver 236, interconnect I/O buffer 234, and photo-detection circuit 214, which includes first LED driver 224 and second LED driver 226. The MCU-voltage-setting signal VMCUSET 213 is set by MCU chip 209, stored in MCU-voltage-setting register VMCUSETR 278, and indicates an operating voltage to be provided to the MCU chip 209 by MCU LDO regulator 208. The MCU enable signal MCUENA 211 can be provided to MCU LDO regulator 208 from either the MCU enable register bit MCUENAR 280 or from a sleep timer. In one embodiment, the sleep timer is provided as sleep timer register SLP_TIMER 282.

Figure 3:
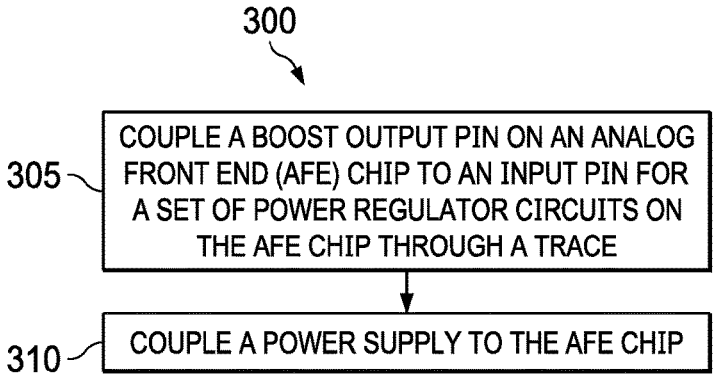
FIG. 3 depicts a process of operating a smoke detector according to an embodiment of the disclosure.

FIG. 3 depicts a process 300 of operating a smoke detector according to an embodiment of the disclosure. Process 300 begins with coupling 305 a boost output pin, e.g., second pin P2, on an analog front end (AFE) chip to an input pin for a set of power regulator circuits, e.g., third pin P3, on the AFE chip through a trace and coupling 310 a power supply to the AFE chip. By coupling the boost output pin to the input pin for the set of power regulator circuits, the first IC chip is able to be coupled to at least the three power configurations disclosed in the embodiments of smoke detection device 100A, 100B and 100C.

Figure 3A:
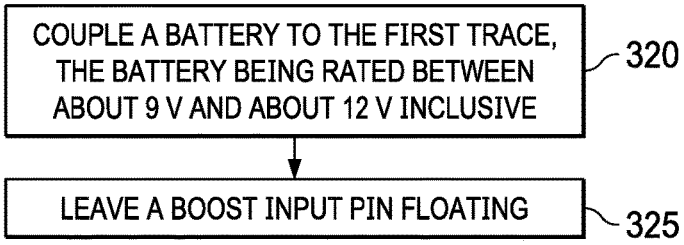
FIGS. 3A-3I depict elements that may be included in the process of FIG. 3.
Figure 3B:
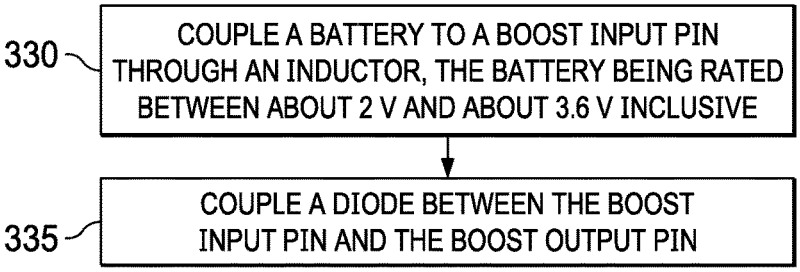
Figure 3C:
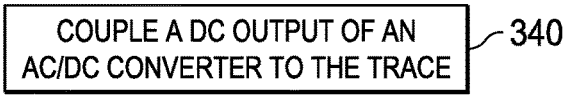

FIGS. 3A-3I each depicts additional actions that may be part of the process 300. In FIG. 3A, a battery, which has a rating between about 9 V and about 12 V inclusive is coupled 320 to the trace and a boost input pin is left floating 325, e.g., as shown in the smoke detection device of FIG. 1C. In FIG. 3B, a battery, which is rated between about 2 V and about 3.6 V inclusive, is coupled 330 to a boost input pin through an inductor and a diode is coupled 335 between the boost input pin and the boost output pin, as shown in the smoke detection device of FIG. 1B. In FIG. 3C, a DC output of an AC/DC converter is coupled 340 to the trace T1; this is done in combination with the elements of FIG. 3B and is illustrated in FIG. 1A.

Figure 3D:
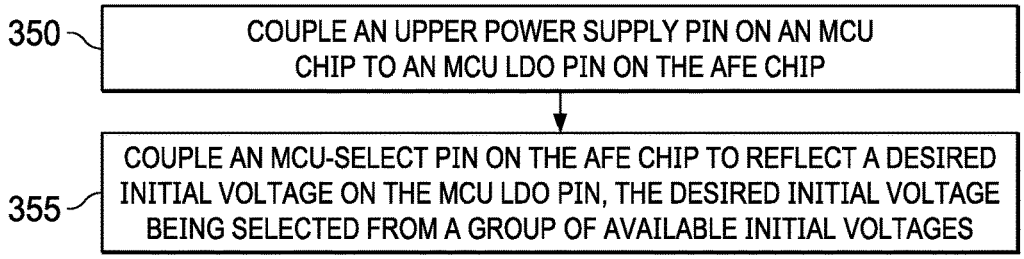
Figure 3E:
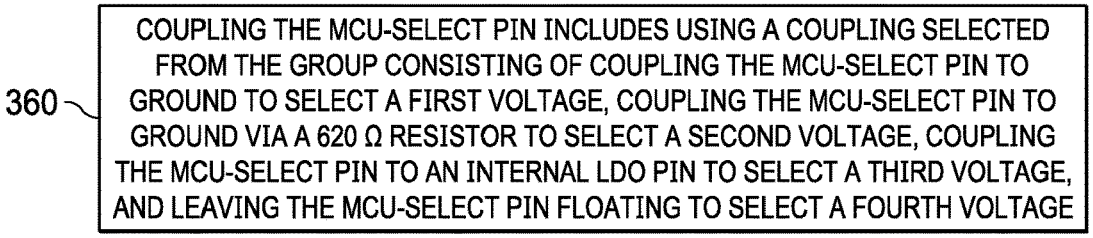

In FIG. 3D, which may be performed in combination with any of the above elements, an upper power supply pin on an MCU chip is coupled to an MCU LDO pin on the AFE chip and an MCU-select pin, e.g., seventh pin P7 (FIG. 2), on the AFE chip is coupled 355 to reflect a desired initial voltage on the MCU LDO pin, the desired initial voltage being selected from a group of available initial voltages. In FIG. 3E, coupling the MCU-select pin is further defined as including using 360 a coupling selected from the group consisting of coupling the MCU-select pin to ground to select a first voltage, coupling the MCU-select pin to ground via a 620Ω resistor to select a second voltage, coupling the MCU-select pin to an internal LDO pin to select a third voltage, and leaving the MCU-select pin floating to select a fourth voltage.

Figure 3F:
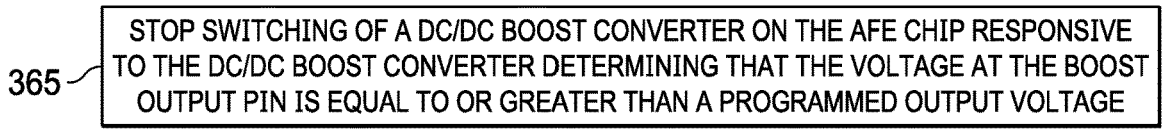
Figure 3G:
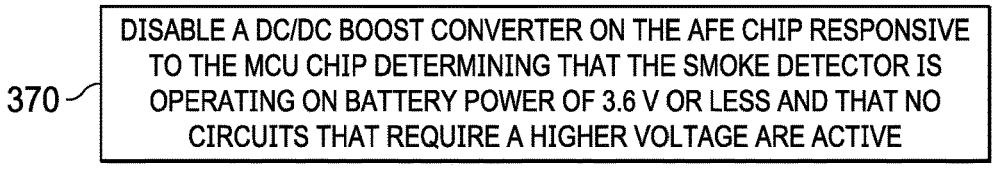
Figure 3H:
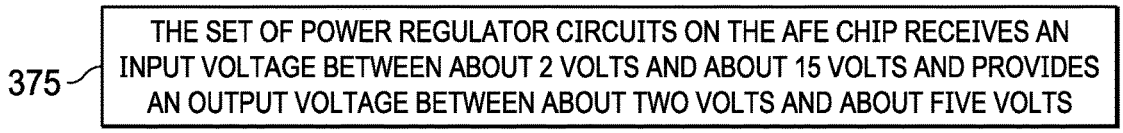
Figure 3I:
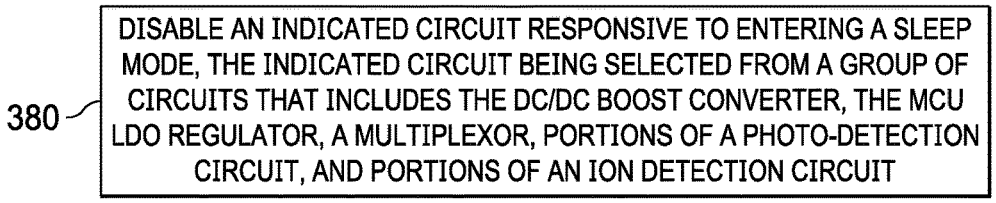

In FIG. 3F, process 300 includes stopping 365 switching of a DC/DC boost converter on the AFE chip responsive to the DC/DC boost converter determining that the voltage at the boost output pin, i.e. boosted output voltage Vbst, is equal to or greater than the programmed boost voltage VPGM. Additionally, when the DC/DC boost converter doesn't switch for a programmable amount of time, e.g., because an AC/DC converter is coupled to trace T1, the MCU chip may also disable the DC/DC boost converter until conditions change. In FIG. 3G, a DC/DC boost converter on the AFE chip may be disabled 370 responsive to the MCU chip determining that the smoke detector is operating on battery power of 3.6 volts or less and that no circuits that require a higher voltage are active, e.g., the horn driver circuit, interconnect I/O buffer, or the MCU LDO in order to supply the MCU chip. In FIG. 3H, the set of power regulator circuits on the AFE chip receives 375 an input voltage between about 2 volts and about 15 volts and provides an output voltage between about two volts and about five volts. This ability of the pre-regulator circuit to receive a wide range of voltages and to provide an output voltage that is safe for low-voltage circuits on the AFE chip provides a great deal of flexibility in providing a power supply to the smoke detector. Finally, in FIG. 3I, an indicated circuit is disabled 380 responsive to entering a sleep mode. The indicated circuit can be selected from a group of circuits that includes the DC/DC boost converter, the MCU LDO regulator, a multiplexor, portions of a photo-detection circuit, and portions of an ion detection circuit.

Applicants have disclosed an AFE chip for a smoke detection device and a smoke detection device that uses the disclosed AFE chip. The AFE chip is designed for versatility with multiple power supply sources and can be utilized with a battery that is rated between 2 V and 15 V, as well as being able to accept mains power through an AC/DC converter. The DC/DC boost converter on the AFE chip is able to detect the voltage at the boost output and to access additional information to determine whether the DC/DC boost converter is needed or not. The pre-regulator circuit can accept a wide range of input voltages and provide an output voltage that is safe for other power circuits on the AFE chip. A process of operating a smoke detector is also disclosed.

Although various embodiments have been shown and described in detail, the claims are not limited to any particular embodiment or example. None of the above Detailed Description should be read as implying that any particular component, element, step, act, or function is essential such that it must be included in the scope of the claims. Reference to an element in the singular is not intended to mean "one and only one" unless explicitly so stated, but rather "one or more." All structural and functional equivalents to the elements of the above-described embodiments that are known to those of ordinary skill in the art are expressly incorporated herein by reference and are intended to be encompassed by the present claims. Accordingly, those skilled in the art will recognize that the exemplary embodiments described herein can be practiced with various modifications and alterations within the spirit and scope of the claims appended below.

What is claimed is:

1. An integrated circuit (IC) chip comprising:

a DC/DC boost converter having a boost input, a boost output, and a boost upper power supply input, the boost input being coupled to a first pin, the boost output being coupled to a second pin, the first pin being adapted for coupling to a battery through an inductor, and the DC/DC boost converter being configured to not switch when a voltage on the second pin is greater than a programmed boost voltage; and a set of power regulator circuits having a power input and a power output, the power input being coupled to a third pin, the third pin being adapted for receiving an input voltage, the power output being coupled to provide an internal voltage, and the set of power regulator circuits being further coupled to the boost upper power supply input.

2. The IC chip as recited in claim 1 in which the set of power regulator circuits includes:

a pre-regulator having a pre-regulator input and a pre-regulator output, the pre-regulator input being coupled to the third pin, the pre-regulator output being coupled to the boost upper power supply input and to a fourth pin;

an internal low dropout (LDO) regulator having an internal-LDO upper power supply input and an internal-LDO output, the internal-LDO upper power supply input being coupled to the pre-regulator output and the internal-LDO output being coupled to a fifth pin; and a microcontroller unit (MCU) LDO regulator, the MCU LDO regulator having an MCU-LDO upper power supply input, an MCU-LDO output and an MCU-select input, the MCU-LDO upper power supply input being coupled to the pre-regulator output, the MCU-LDO output being coupled to a sixth pin, and the MCU-select input being coupled to a seventh pin, the sixth pin being adapted for coupling to an MCU.

3. The IC chip as recited in claim 2 including:

a carbon monoxide (CO) detection circuit having a CO upper power supply input and a CO output, the CO upper power supply input being coupled to the internal LDO output and CO detection circuit being coupled to a plurality of CO pins;

a photo detection circuit having a photo upper power supply input, a first photo output and a second photo output, the photo upper power supply input coupled to the internal LDO output and the photo detection circuit being coupled to a plurality of photo pins;

an ion detection circuit having an ion upper power supply input and an ion output, the ion upper power supply input being coupled to the boost output and the ion detection circuit being coupled to a plurality of ion pins;

a multiplexor (MUX) having a MUX upper power supply input, a MUX output, a first MUX input, a second MUX input, a third MUX input, and a fourth MUX input, the MUX upper power supply input being coupled to the internal LDO output, the first MUX input coupled to the CO output, the second MUX input coupled to the first photo output, the third MUX input coupled to the second photo output, and the fourth MUX input being coupled to the ion detection output; and a buffer amplifier coupled between the MUX output and a MUX pin.

4. The IC chip as recited in claim 3 including:

a horn driver having a horn upper power supply input and a horn enable signal, the horn upper power supply input being coupled to the boost output and the horn driver being coupled to a plurality of horn pins; and an interconnect I/O buffer coupled between a first interconnect pin and a second interconnect pin.

5. A smoke detection device comprising:

an analog front end (AFE) chip including a DC/DC boost converter having a boost input, a boost output, and a boost upper power supply input, the boost input being coupled to a first pin and the boost output being coupled to a second pin, and a set of power regulator circuits having a power input and a power output, the power input being coupled to a third pin, the third pin being adapted for receiving an input voltage, the power output being coupled to provide an internal voltage; and a trace that couples the second pin to the third pin.

6. The smoke detection device as recited in claim 5 including:

a battery coupled to the first pin through an inductor, the battery having a voltage between about 2 volts and about 3.6 volts; and a first diode coupled between the first pin and the second pin.

7. The smoke detection device as recited in claim 6 including an AC-DC converter having a DC output coupled to the trace through a second diode.

8. The smoke detection device as recited in claim 5 including:

the first pin being floating; and a battery coupled to the trace, the battery having a voltage of about nine volts or greater.

9. The smoke detection device as recited in claim 5 in which the AFE chip includes:

a carbon monoxide (CO) detection circuit having a CO upper power supply input and a CO output, the CO upper power supply input being coupled to an internal LDO output and the CO detection circuit being coupled to a plurality of CO pins;

a photo-detection circuit having a photo upper power supply input, a first photo output and a second photo output, the photo upper power supply input coupled to the internal LDO output and the photo-detection circuit being coupled to a plurality of photo pins;

an ion detection circuit having an ion upper power supply input and an ion output, the ion upper power supply input being coupled to the boost output and the ion detection circuit being coupled to a plurality of ion pins;

a multiplexor (MUX) having a MUX upper power supply input, a MUX output, a first MUX input, a second MUX input, a third MUX input, and a fourth MUX input, the MUX upper power supply input being coupled to the internal LDO output, the first MUX input coupled to the CO output, the second MUX input coupled to the first photo output, the third MUX input coupled to the second photo output, the fourth MUX input being coupled to the ion detection output; and the MUX output being coupled to a MUX pin;

an interconnect I/O buffer coupled between a first interconnect pin and a second interconnect pin; and a horn driver having a horn upper power supply input and a horn enable signal, the horn upper power supply input being coupled to the boost output and the horn driver being coupled to a plurality of horn pins; and the set of power regulator circuits includes:

a pre-regulator having a pre-regulator input and a pre-regulator output, the pre-regulator input being coupled to the third pin, the pre-regulator output being coupled to the boost upper power supply input and to a fourth pin, an internal low dropout (LDO) regulator having an internal-LDO upper power supply input and an internal-LDO output, the internal-LDO upper power supply input being coupled to the pre-regulator output and the internal-LDO output being coupled to a fifth pin, and a microcontroller unit (MCU) LDO regulator, the MCU LDO regulator having an MCU-LDO upper power supply input, an MCU-LDO output and an MCU-select input, the MCU-LDO upper power supply input being coupled to the pre-regulator output, the MCU-LDO output being coupled to a sixth pin, and the MCU-select input being coupled to a seventh pin.

10. The smoke detection device as recited in claim 9 including:

a microcontroller unit (MCU) chip, the MCU chip having an MCU upper power supply pin and a plurality of MCU I/O pins, the MCU upper power supply pin coupled to the sixth pin, a first MCU pin of the plurality of MCU I/O pins being coupled to the MUX pin and a second pin of the plurality of MCU I/O pins coupled to the first interconnect pin.

11. The smoke detection device as recited in claim 10 including:

a carbon monoxide (CO) detector having a plurality of CO terminals coupled to the plurality of CO pins;

a first light emitting diode (LED) and a second LED having a plurality of LED terminals;

a photodiode having a plurality of photodiode terminals, the LED terminals and the photodiode terminals being coupled to the plurality of photo pins;

an ion sensor having a plurality of terminals coupled to the plurality of ion pins; and a horn having a plurality of terminals coupled to the plurality of horn pins.

12. A process comprising:

coupling an output pin for a DC/DC boost converter on an analog front end (AFE) chip to an input pin for a set of power regulator circuits on the AFE chip through a trace; and coupling a power supply to the AFE chip; and stopping switching of the DC/DC boost converter responsive to the DC/DC boost converter determining that a voltage at the boost output pin is equal to or greater than a programmed boost voltage.

13. The process as recited in claim 12 in which coupling the power supply to the AFE chip includes coupling a battery to the trace and leaving an input pin for the DC/DC boost converter floating, the battery being rated between about 9 V and about 12 V inclusive.

14. The process as recited in claim 12 in which coupling the power supply to the AFE chip includes:

coupling a battery to an input pin for the DC/DC boost converter through an inductor, the battery having a voltage between about 3 volts and about 3.6 volts; and coupling a diode between the input pin for the DC/DC boost converter and the output pin for the DC/DC boost converter.

15. The process as recited in claim 14 including coupling a DC output of an AC-DC converter to the trace.

16. The process as recited in claim 12 including:

coupling an upper power supply pin on an MCU chip to a microcontroller unit (MCU) low-dropout (LDO) pin on the AFE chip; and coupling an MCU-select pin on the AFE chip to reflect a desired initial voltage on the MCU LDO pin, the desired initial voltage being selected from a group of available initial voltages.

17. The process as recited in claim 16 in which coupling the MCU-select pin includes using a coupling selected from the group consisting of coupling the MCU-select pin to ground to select a first voltage; coupling the MCU-select pin to ground via a 620Ω resistor to select a second voltage; coupling the MCU-select pin to an internal LDO pin to select a third voltage; and leaving the MCU-select pin floating to select a fourth voltage.

18. The process as recited in claim 16 including disabling the DC/DC boost converter on the AFE chip responsive to the MCU chip determining that a smoke detector is operating on battery power of 3.6 volts or less and that no circuits that require a higher voltage are active.

19. The process as recited in claim 12 including the set of power regulator circuits on the AFE chip receiving an input voltage between about 2 volts and about 15 volts and providing an output voltage between about two volts and about five volts.

20. The process as recited in claim 16 including disabling an indicated circuit responsive to entering a sleep mode, the indicated circuit being selected from a group of circuits that includes the DC/DC boost converter, the MCU LDO regulator, a multiplexor, portions of a photo-detection circuit, and portions of an ion detection circuit.

* * * * *